US007891278B2

(12) United States Patent
Liu et al.

(10) Patent No.: US 7,891,278 B2
(45) Date of Patent: Feb. 22, 2011

(54) EYE-PROTECTION COVER QUICK-RELEASE STRUCTURE FOR TABLE SAW

(75) Inventors: Chia-Sheng Liu, Taichung County (TW); Chen-Yuan Chen, Taichung County (TW)

(73) Assignee: Durq Machinery Corp., Taichung (TW)

( * ) Notice: Subject to any disclaimer, the term of this patent is extended or adjusted under 35 U.S.C. 154(b) by 272 days.

(21) Appl. No.: 12/318,889

(22) Filed: Jan. 12, 2009

(65) Prior Publication Data

US 2010/0116114 A1 May 13, 2010

(30) Foreign Application Priority Data

Nov. 10, 2008 (TW) ..... 97143414 A

(51) Int. Cl.
*B26D 7/24* (2006.01)
*B27G 19/08* (2006.01)
*B27G 19/00* (2006.01)

(52) U.S. Cl. ..... 83/478; 83/102.1

(58) Field of Classification Search ..... 83/478, 83/102.1, 701, 477.2, 397, 522.12, 860, 440.2; 403/348, 353; 411/349, 549, 553; 24/458
See application file for complete search history.

(56) References Cited

U.S. PATENT DOCUMENTS 7,437,981 B2 * 10/2008 Burke et al. ..... 83/102.1
7,546,792 B2 * 6/2009 Liu et al. ..... 83/478
2001/0035081 A1 * 11/2001 Sutton ..... 83/102.1
2002/0174755 A1 * 11/2002 Behne et al. ..... 83/446
2007/0056416 A1 * 3/2007 Shibata ..... 83/440.2
2008/0022827 A1 * 1/2008 Weir et al. ..... 83/478
2010/0101390 A1 * 4/2010 Chiu ..... 83/102.1
2010/0257990 A1 * 10/2010 Schell et al. ..... 83/397

* cited by examiner

*Primary Examiner*—Ghassem Alie
(74) *Attorney, Agent, or Firm*—Bacon & Thomas, PLLC

(57) ABSTRACT

An eye-protection cover quick-release structure includes a spreader, which has a notch and a locating hole at the top side and a contracted passage connected between the notch and the locating hole, a bracket, which has a locating groove for accommodating a part of the spreader and an axle hole, an axle pin, which is insertable through the axle hole of the bracket and the locating hole of the spreader and has a shank and a shoulder, and a handle fastened to the shank of the axle pin and biasable between a pressed position where the shoulder of the axle pin is forced into the locating hole of the spreader to lock the bracket to the spreader and a lifted position where the shank of the axle pin is forced into the locating hole of the spreader and movable through the contracted passage for allowing the bracket to be separated from the spreader.

7 Claims, 8 Drawing Sheets

EYE-PROTECTION COVER QUICK-RELEASE STRUCTURE FOR TABLE SAW

BACKGROUND OF THE INVENTION

1. Field of the Invention

The present invention relates to a table saw and more particularly, to an eye-protection cover quick-release structure for table saw.

2. Description of the Related Art

Convenience and safety are emphasized factors of the functioning of a machine tool. For example, when designing the mounting arrangement of an eye-protection cover and a spreader for a table saw, connection stability and quick detachability are important factors must be taken into account.

FIGS. 1~3 illustrates the mounting arrangement of an eye-protection cover 1 and a spreader 5 for table saw according to the prior art. According to this design, the eye-protection cover 1 includes a cover body 2, a bracket 3 pivoted with its one end to the cover body 2, and a quick-release 4 provided at the other end of the bracket 3 for quickly detachably connecting the bracket 3 to the spreader 5. The quick-release 4 includes a left axle sleeve 4*a*, a right axle sleeve 4*b* respectively fastened to a left board 3*a* and a right board 3*b* of the bracket 3 with a respective nut 4*c*, a spring 4*d* and a bushing 4*e* mounted in the left axle sleeve 4*a*, and a press member 4*f* mounted in the right axle sleeve 4*b*, thereby defining an abutment line L that is kept passing through the contact area between the bushing 4*e* and the press member 4*f*.

The spring 4*d* imparts a pressure to the bushing 4*e* to force the housing 4*e* into a circular through hole 5*a* near the top edge of the spreader 5, thereby securing the eye-protection cover 1 to the spreader 5. When wishing to separate the eye-protection cover 1 from the spreader 5, lift the cover body 2 with one hand to have the quick-release 4 be exposed to the outside, and then press the press member 4*f* with the other hand to push the bushing 4*e* backwards and to further change the position of the abutment line L, as shown in FIG. 3. When the abutment line L is in alignment with the spreader 5, pull the cover body 2 to carry the bracket 3 away from the spreader 5. However, it is difficult to move the abutment line L into accurate alignment with the spreader 5. The user may have to push and release the press member 4*f* and simultaneously lifting the cover body 2 several times, trying to control the applied pressure accurately. When connecting the eye-protection cover 1 to the spreader 5, the installation may be done after through several trials.

SUMMARY OF THE INVENTION

The present invention has been accomplished under the circumstances in view. It is the main object of the present invention to provide an eye-protection cover quick-release structure, which facilitates quick mounting and dismounting of the eye-protection cover.

To achieve this and other objects of the present invention, an eye-protection cover quick-release structure comprises a spreader, which comprises a notch and a locating hole disposed in a top edge thereof and a contracted passage connected between the notch and the locating hole, a bracket, which comprises a locating groove for accommodating a part of the spreader, an axle hole transversely extending across the locating groove corresponding to the locating hole of the spreader, and at least one guide block protruded from a sidewall of the bracket adjacent to the axle hole, an axle pin, which is insertable through the axle hole of the bracket and the locating hole of the spreader and comprises a shank and a shoulder at one end of the shank, and a handle, which is fastened to the shank of the axle pin and biasable between a pressed position and a lifted position and comprises at least one protruding block.

When the handle is in the pressed position, the at least one protruding block of the handle touches the at least one guide block of the bracket to move the axle pin in one direction and to further force the shoulder of the axle pin into the locating hole of the spreader, thereby locking the bracket to the spreader. On the contrary when the handle is in the lifted position, the at least one protruding block of the handle is kept away from the at least one guide block of the bracket, and the shank of the axle pin is inserted into the locating hole of the spreader and movable through the contracted passage for allowing the bracket to be separated from the spreader.

DETAILED DESCRIPTION OF THE INVENTION

Figure 1:
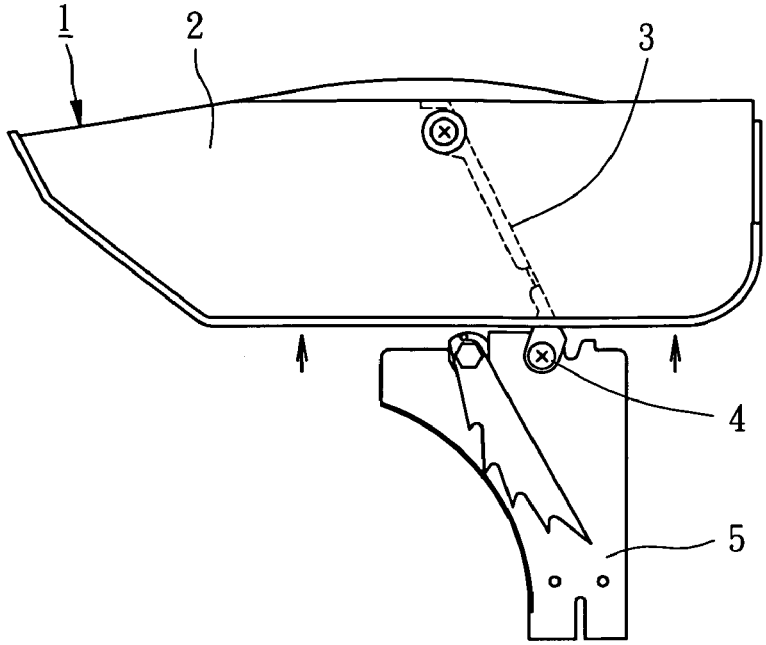
FIG. 1 PRIOR ART
FIG. 1 is a schematic drawing showing a mounting arrangement of an eye-protection cover and a spreader for table saw according to the prior art.
Figure 2:
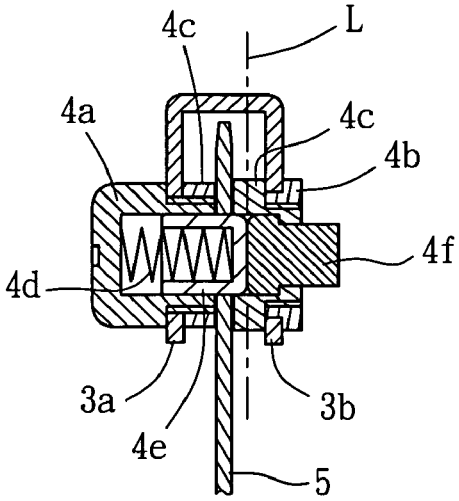
FIG. 2 PRIOR ART
FIG. 2 is a sectional view of the prior art design, showing the eye-protection cover and the spreader locked.
Figure 3:
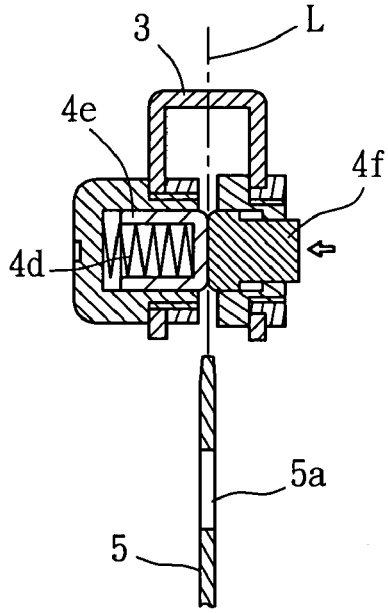
FIG. 3 PRIOR ART
FIG. 3 is similar to FIG. 2 but showing the eye-protection cover unlocked from the spreader.
Figure 4:
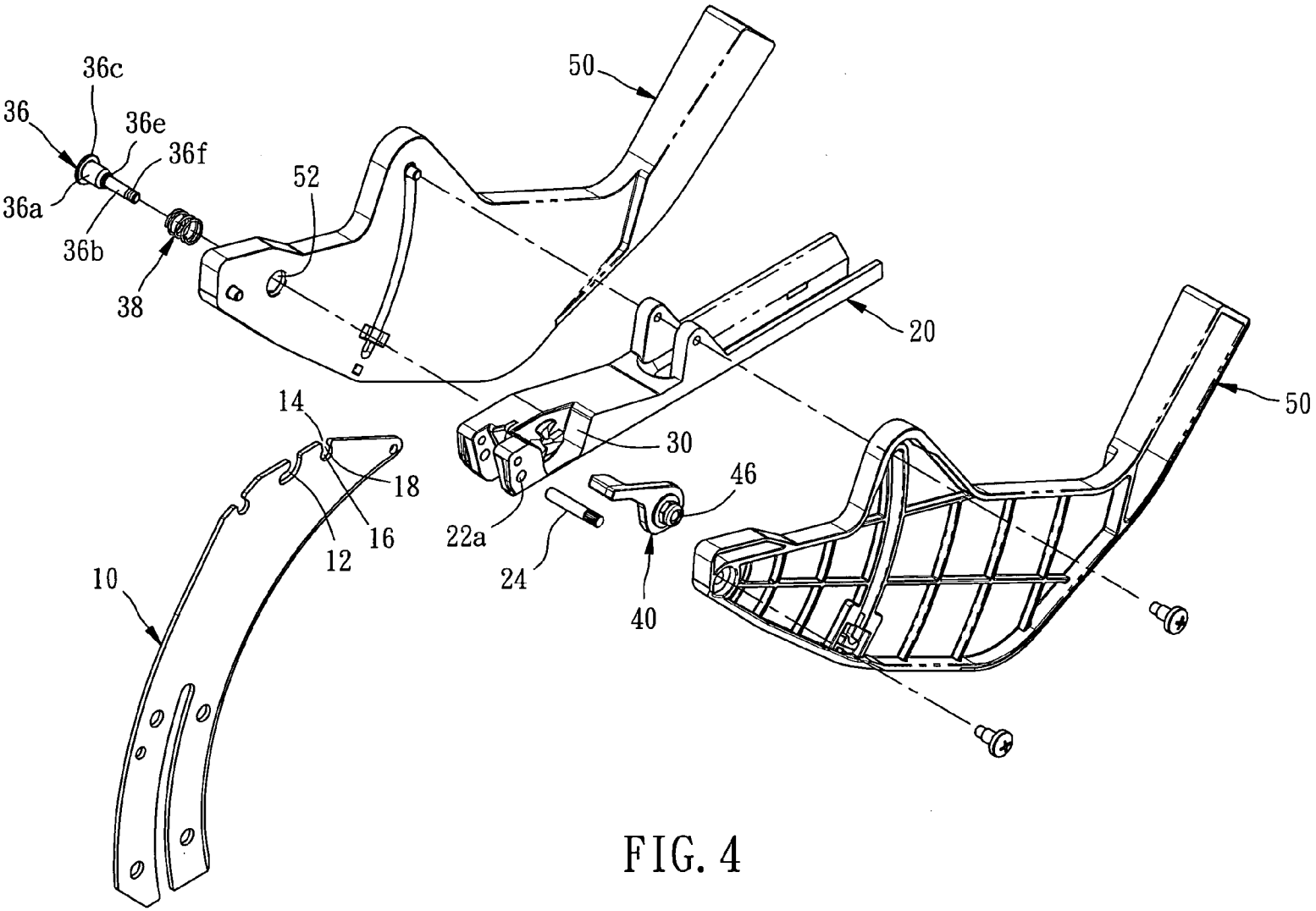
FIG. 4 is an exploded view of an eye-protection cover quick-release structure for table saw according to the present invention.

Referring to FIG. 4, an eye-protection cover quick-release structure in accordance with present invention includes a spreader 10, a bracket 20, an axle pin 36, a spring member 38, a handle 40, and two cover boards 50.

The spreader 10 is a plate member having an angled slot 12 extended to the top edge, a locating hole 16 disposed at one lateral side relative to the angled slot 12, a notch 14 on the top edge, and a contracted passage 18 connected between the locating hole 16 and the top notch 14. The angled slot 12 and the notch 14 have one side opened. The locating hole 16 has a tapered portion 16*a* (see FIG. 10).

Figure 5:
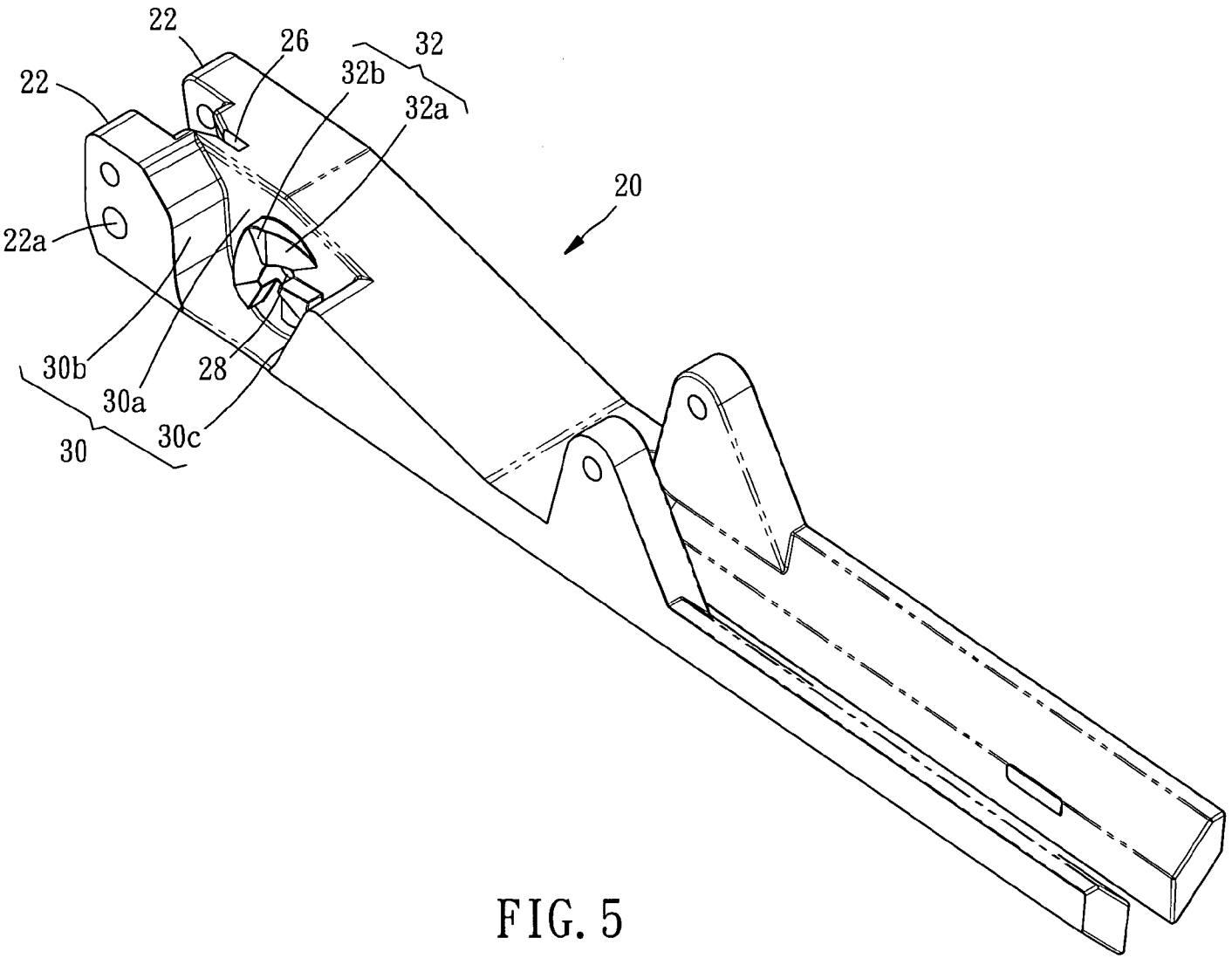
FIG. 5 is a perspective view of the bracket of the eye-protection cover quick-release structure according to the present invention.

Referring to FIG. 5 and FIG. 4 again, the bracket 20 has one end terminating in two parallel lugs 22. Each lug 22 has a through hole 22*a*. A transverse rod 24 is inserted through the through holes 22*a* of the lugs 22 and coupled to the angled slot 12 of the spreader 10 to secure the bracket 20 to the spreader 10. A longitudinal locating groove 26 is formed in the bracket 20 between the lugs 22 for accommodating an upper part of the spreader 10. An axle hole 28 is transversely formed in the bracket 20 and kept in communication with the locating groove 26. The locating groove 26 has a width approximately equal to the thickness of the spreader 10 so that the spreader 10 is kept from vibration relative to the bracket 20 when it is accommodated in the locating groove 26. After the spreader 10 is accommodated in the locating groove 26, the axle hole 28 is kept in alignment with the locating hole 16 of the spreader 10. The bracket 20 further has an open-type accommodation chamber 30 disposed adjacent to the lugs 22 and surrounded by a sidewall 30*a*, a front top wall 30*b* and a rear stop wall 30*c*, and three guide blocks 32 protruded from the sidewall 30*a* and spaced around the axle hole 28. Each guide block 32 has a forward slope 32*a* and a backward slope 32*b*. The backward slope 32*b* is substantially a horizontal plane that slopes slightly downwards, i.e., the backward slope 32*b* is disposed at a relatively higher place. Further, a shoulder 34 is defined in the bracket 20 between the locating groove 26 and the axle hole 28, as shown in FIG. 10.

The axle pin 36 is inserted through the axle hole 28 of the bracket 20, having a head 36*c* disposed at one end, a threaded endpiece 36*f* disposed at the other end, a shank 36*b* connected between the head 36*c* and the threaded endpiece 36*f*, a shoulder 36*a* connected between the shank 36*b* and the head 36*c*, a tool hole 36*d* formed on the top side of the head 36*c* opposite to the shoulder 36*a* (see FIG. 10), and a tapered portion 36*e* connected between the shoulder 36*a* and the shank 36*b*.

Figure 10:
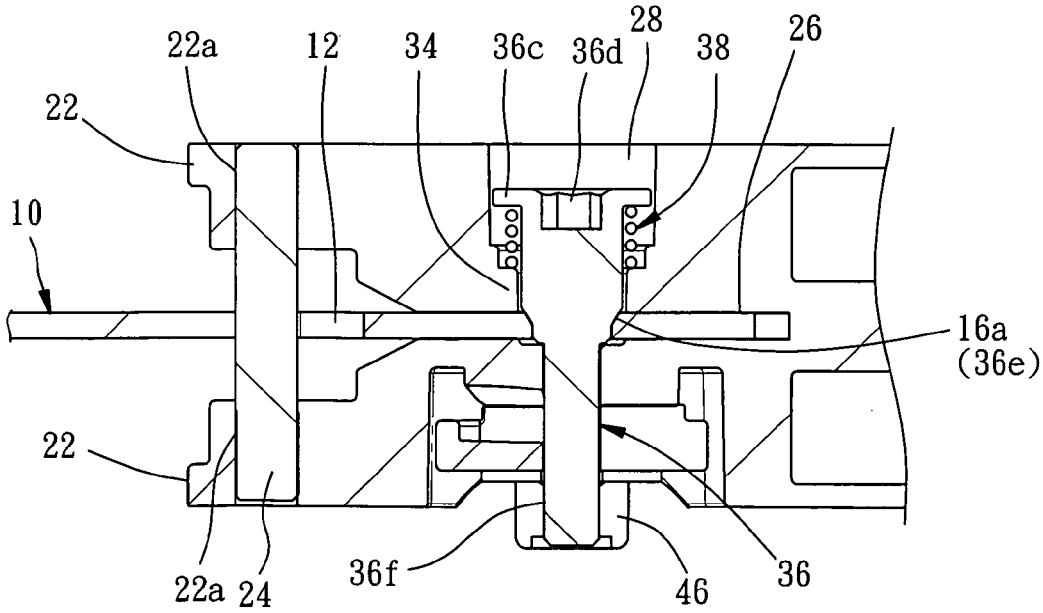
FIG. 10 is a sectional view taken in an enlarged scale along line 10-10 of FIG. 8.

The spring member 38 is mounted in the axle hole 28 and sleeved onto the axle pin 36, having one end stopped against the head 36*c* of the axle pin 36 and the other end stopped against a shoulder 34 of the bracket 20 (see FIG. 10).

Figure 6:
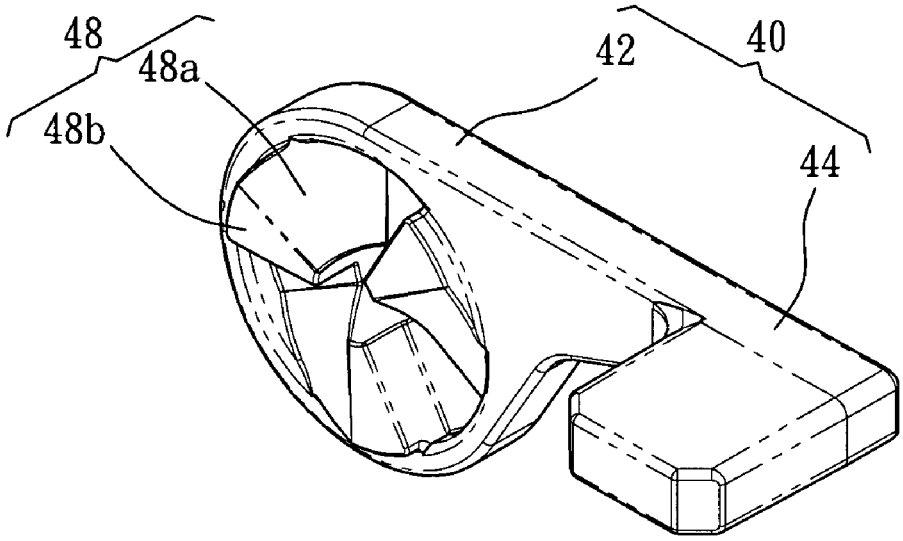
FIG. 6 is a perspective view of the handle of the eye-protection cover quick-release structure according to the present invention.
Figure 7:
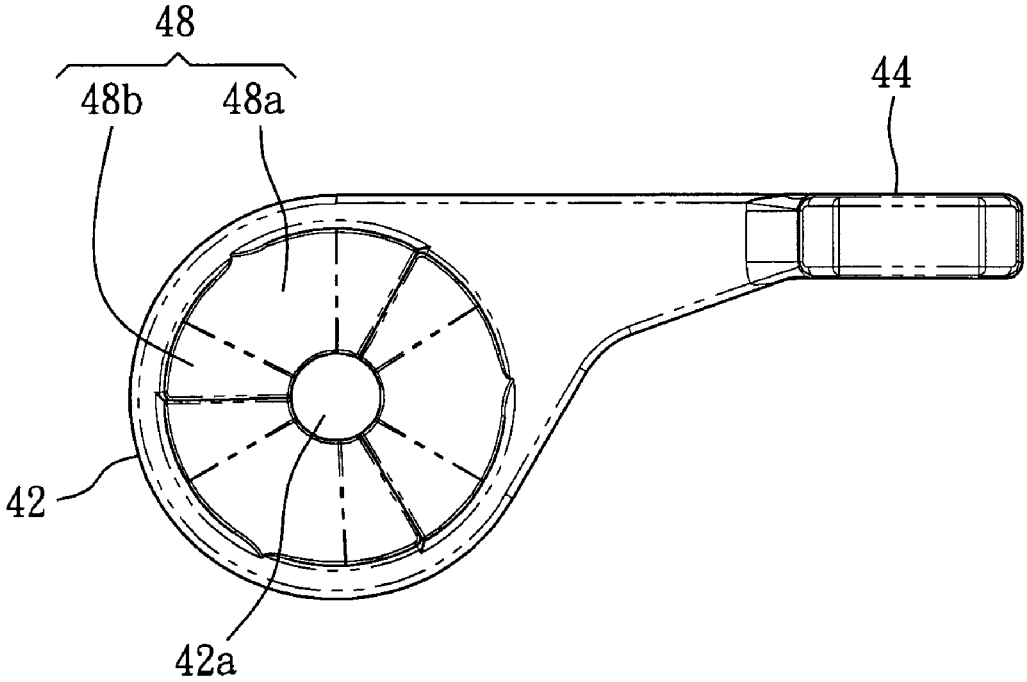
FIG. 7 is a side view of the handle of the eye-protection cover quick-release structure according to the present invention.

Referring to FIGS. 6 and 7, the handle 40 has a disk-like base 42 and a grip 44. The disk-like base 42 has a through hole 42*a* for the passing of the shank 36*b* of the axle pin 36. A nut 46 is threaded onto the threaded endpiece 36*f* to let the handle 40 be accommodated in the accommodation chamber 30 of the bracket 20. The disk-like base 42 has three protruding blocks 48 protruded from its one side around the through hole 42*a*. Each protruding block 48 has a forward slope 48*a* and a backward slope 48*b*. The backward slope 48*b* slopes slightly downwards and is disposed at a relatively higher place. When biasing the grip 44 of the handle 40 in one direction to have the grip 44 be stopped against the front stop wall 30*b* in the accommodation chamber 30, the handle 40 is stopped in the pressed position P1 shown in FIG. 8. On the contrary, when biasing the grip 44 of the handle 40 in the reversed direction to have the grip 44 be stopped against the rear stop wall 30*c* in the accommodation chamber 30, the handle 40 is stopped in the lifted position P2 shown in FIG. 11.

The two cover boards 50 are respectively pivoted to the left and right sides of the bracket 20. One cover board 50 has a through hole 52 corresponding to the tool hole 36*d* of the axle pin 36.

After understanding of the detailed structural features of the component parts of the eye-protection cover quick-release and their relative positioning, the operation of the eye-protection cover quick-release structure is described hereinafter.

Figure 8:
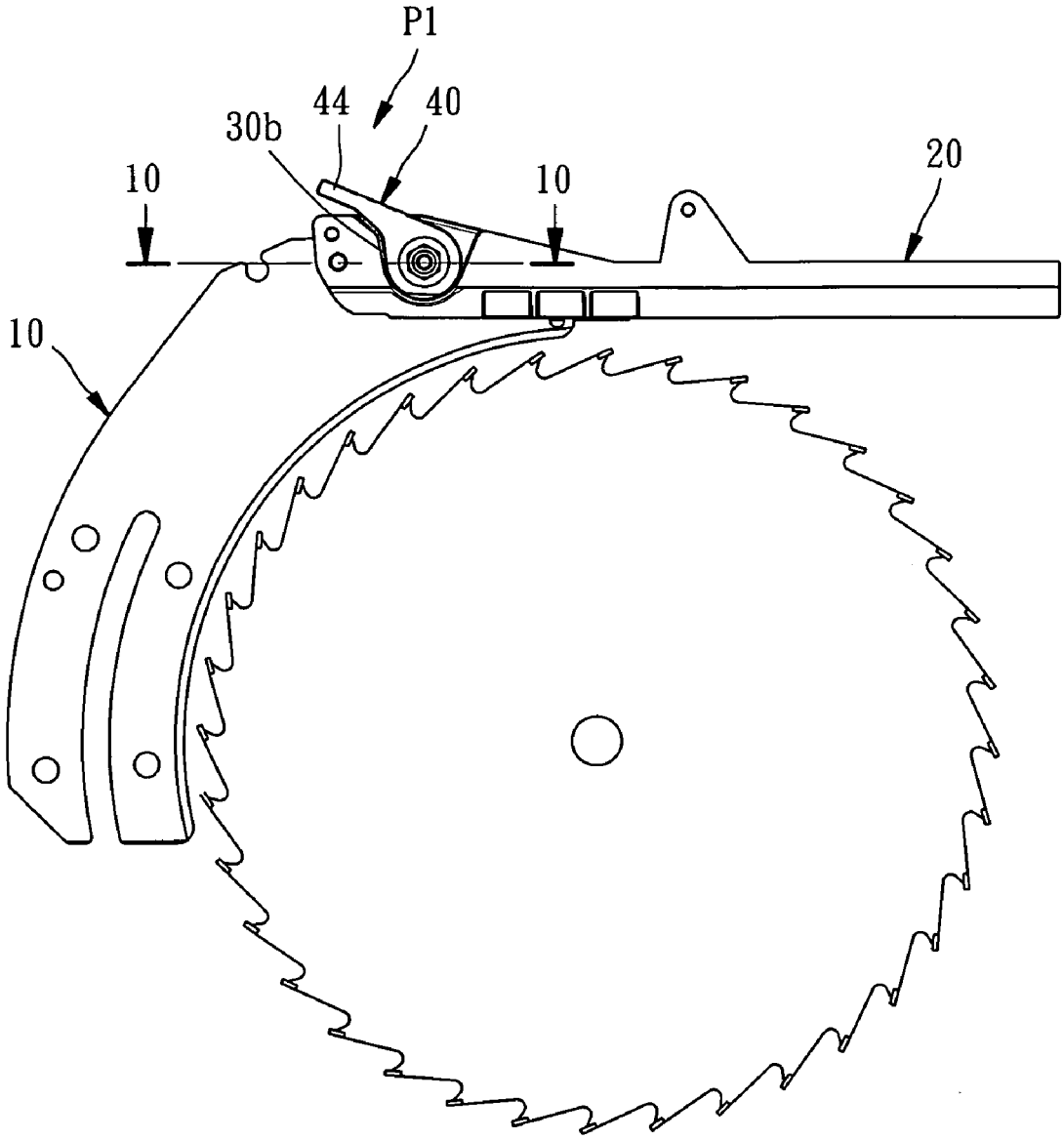
FIG. 8 is a schematic installed view of the present invention, showing the handle in the pressed position.
Figure 9:
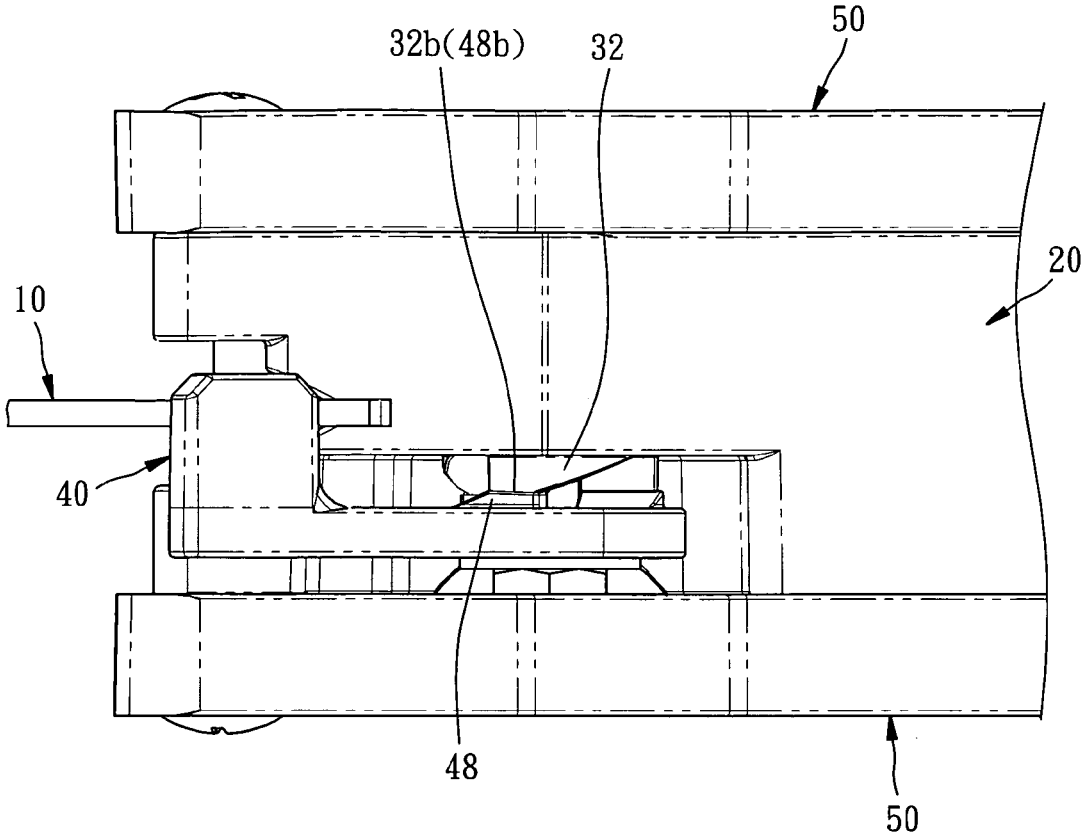
FIG. 9 is a top view in an enlarged scale of a part of FIG. 8.

FIGS. 8 and 9 show the handle 40 in the pressed position P1. At this time, the backward slopes 48*b* of the protruding blocks 48 of the handle 40 are respectively stopped against the backward slopes 32*b* of the guide blocks 32 of the bracket 20, and the axle pin 36 is forced toward the spreader 10 to engage the tapered portion 36*e* into the tapered portion 16*a* of the locating hole 16 of the spreader 10, as shown in FIG. 10, prohibiting disconnection of the bracket 20 from the spreader 10. Further, the axle pin 36 imparts a lateral pressure to the spreader 10 at this time, enhancing the engagement tightness between the bracket 20 and the spreader 10. Further, abutting the backward slopes 48*b* of the protruding blocks 48 of the handle 40 against the backward slopes 32*b* of the guide blocks 32 of the bracket 20 provides an effect of holding the handle 40 in the pressed position P1.

Figure 11:
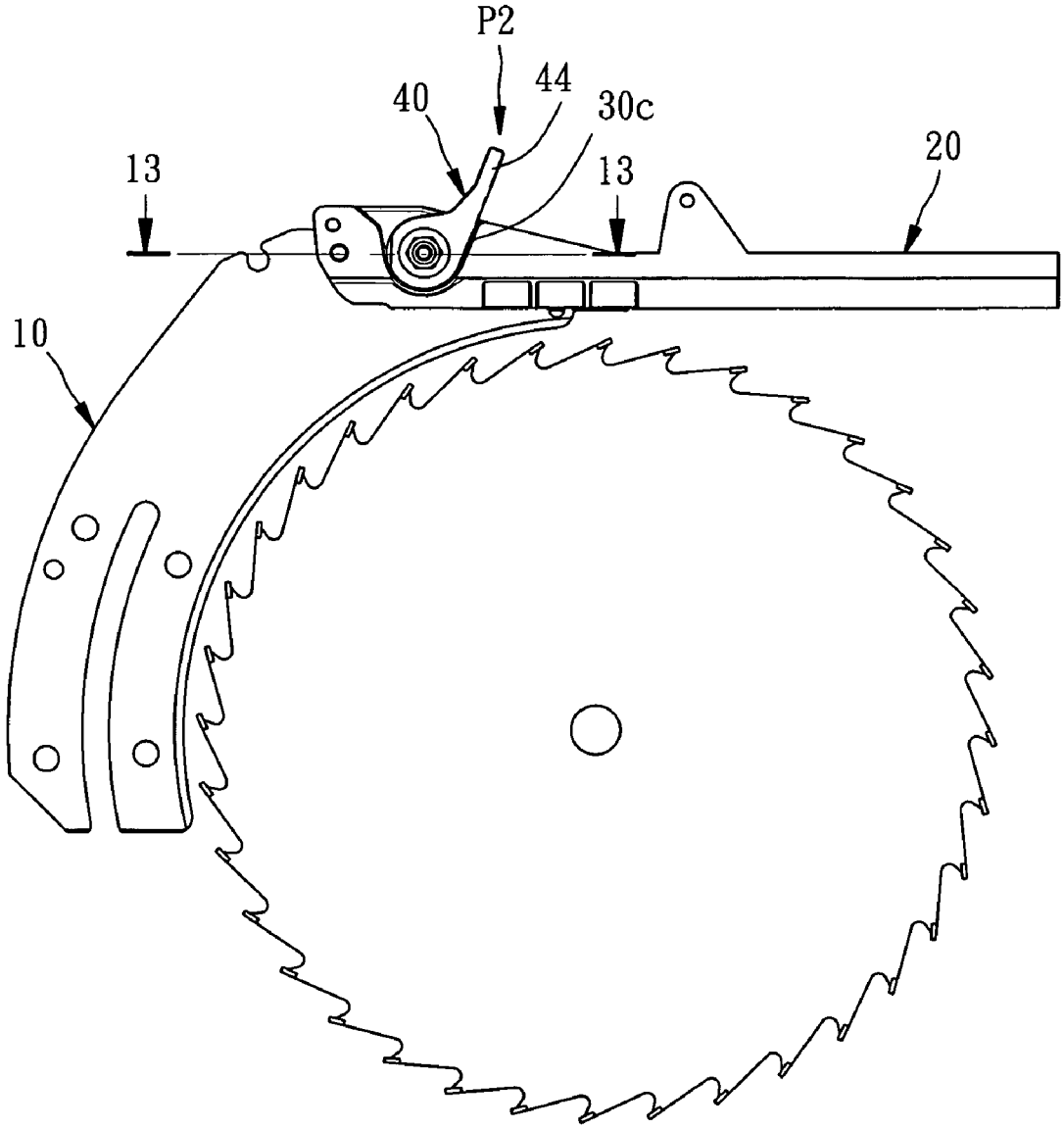
FIG. 11 is similar to FIG. 8 but showing the handle in the lifted position.
Figure 12:
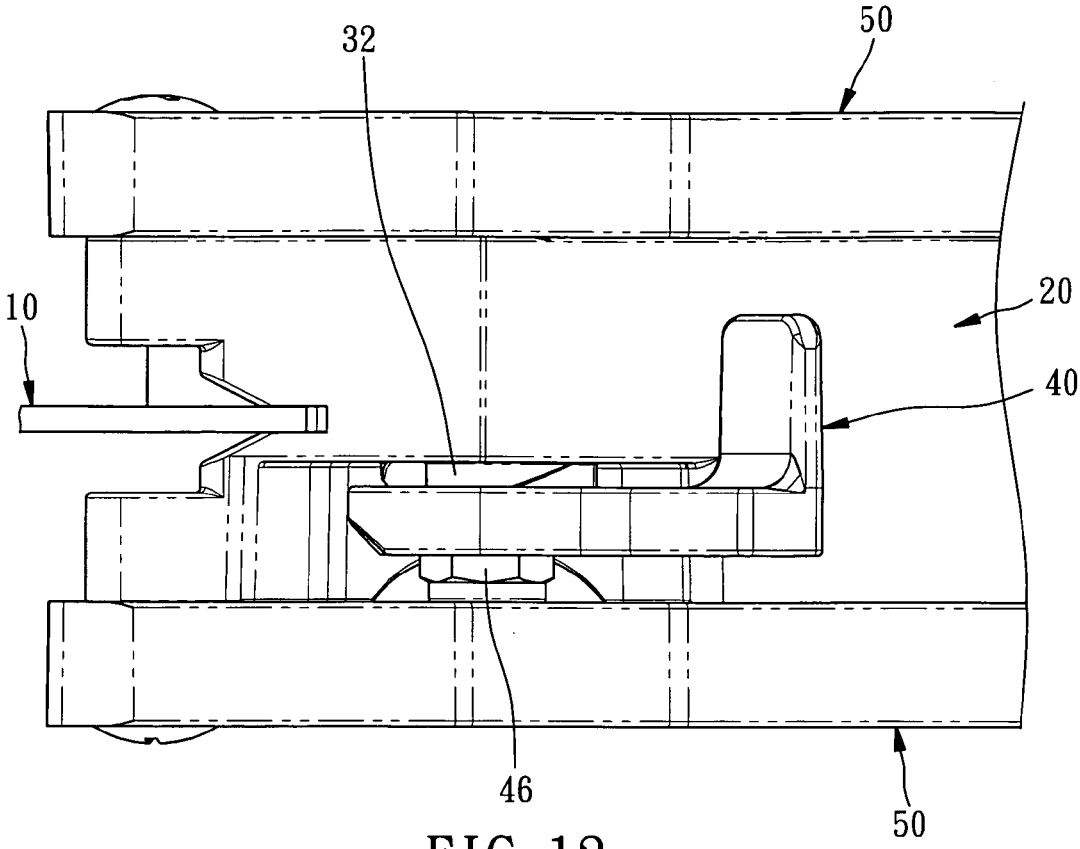
FIG. 12 is a top view in an enlarged scale of a part of FIG. 11.
Figure 13:
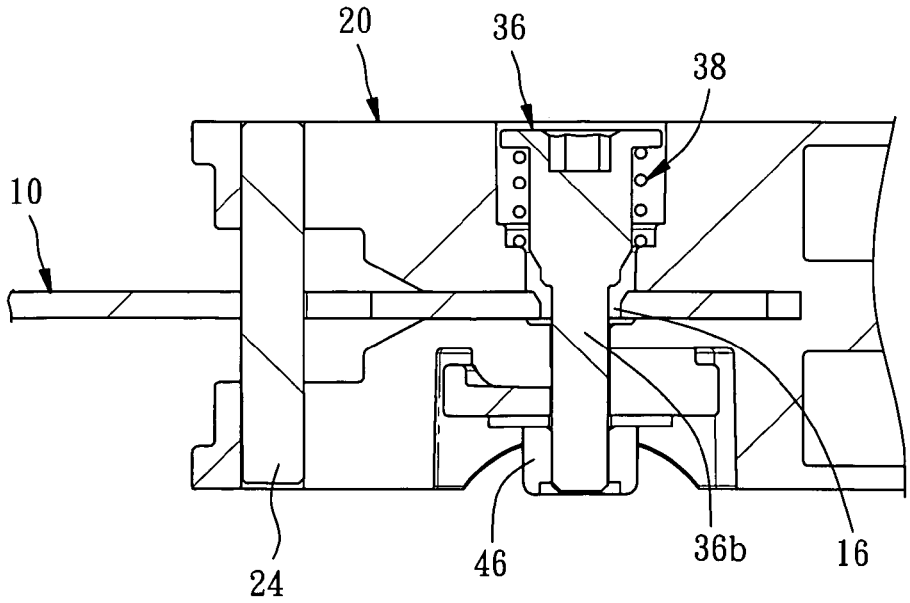
FIG. 13 is a sectional view taken in an enlarged scale along line 13-13 of FIG. 11.

When wishing to detach the bracket 20 and the cover boards 50 from the spreader 10, bias the handle 40 to overcome the engagement pressure between the backward slopes 48*b* of the protruding blocks 48 of the handle 40 and the backward slopes 32*b* of the guide blocks 32 of the bracket 20, see FIGS. 11 and 12, enabling the spring member 38 to push the axle pin 36 backwards, see FIG. 13, forcing the handle 40 to stop the grip 44 against the rear stop wall 30*c* in the accommodation chamber 30, and therefore the handle 40 is stopped in the lifted position P2. At this time, the shank 36*b* of the axle pin 36 is kept in the locating hole 16 of the spreader 10 and can be moved through the contracted passage 18. Thus, the user can lift the handle 40 with one hand to separate the bracket 20 and the cover boards 50 from the spreader 10.

Further, a tool can be inserted through the through hole 52 of the cover board 50 into the tool hole 36*d* of the axle pin 36 to rotate the axle pin 36, thereby adjusting the lateral pressure that is applied by the axle pin 36 to the spreader 10.

Further, in the aforesaid preferred embodiment, engagement between the backward slopes 48*b* of the protruding blocks 48 of the handle 40 and the backward slopes 32*b* of the guide blocks 32 of the bracket 20 holds the handle 40 in the pressed position P1. The eye-protection cover quick-release structure can be so designed that only the protruding blocks 48 of the handle 40 or the guide blocks 32 of the bracket 20 have a backward slope, achieving the same positioning effect.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An eye-protection cover quick-release structure, comprising:

a spreader, said spreader comprising a notch and a locating hole disposed in a top edge thereof, and a contracted passage connected between said notch and said locating hole;

a bracket, said bracket comprising a locating groove for accommodating a part of said spreader, an axle hole transversely extending across said locating groove corresponding to said locating hole of said spreader, and at least one guide block protruded from a sidewall of said bracket adjacent to said axle hole;

an axle pin insertable through said axle hole of said bracket and said locating hole of said spreader, said axle pin comprising a shank and a shoulder at one end of said shank; and a handle fastened to said shank of said axle pin and biasable between a pressed position and a lifted position, said handle comprising at least one protruding block;

wherein when said handle is in said pressed position, the at least one protruding block of said handle touches the at least one guide block of said bracket to move said axle pin in one direction and to further force the shoulder of said axle pin into said locating hole of said spreader, thereby locking said bracket to said spreader; when said handle is in said lifted position, the at least one protruding block of said handle is kept away from the at least one guide block of said bracket, and the shank of said axle pin is inserted into said locating hole of said spreader and movable through said contracted passage for allowing said bracket to be separated from said spreader.

2. The eye-protection cover quick-release structure as claimed in claim 1, wherein at least one of the at least one guide block of said bracket and at least one protruding block of said handle has a backward slope for stopping said handle in said pressed position.

3. The eye-protection cover quick-release structure as claimed in claim 1, wherein said bracket comprises a shoulder disposed between said axle hole and said locating groove; said axle pin further comprises a head radially extending outward from one end of said shoulder opposite to said shank and is mounted with a spring member that is sleeved onto said axle pin and stopped between said head and the shoulder of said bracket.

4. The eye-protection cover quick-release structure as claimed in claim 1, wherein said spreader has a thickness approximately equal to the width of said locating groove of said bracket; said locating hole of said spreader comprises a tapered portion; said axle pin further comprises a tapered portion connected between the shoulder and shank thereof for stopping against the tapered portion of said locating hole of said spreader when said handle is in said pressed position.

5. The eye-protection cover quick-release structure as claimed in claim 1, wherein said spreader further comprises a slot extended to a top edge thereof; said bracket comprises a transverse rod disposed adjacent to said axle hole for engaging into said slot of said spreader to secure said bracket to said spreader.

6. The eye-protection cover quick-release structure as claimed in claim 1, wherein said handle comprises a through hole; said axle pin further comprises a tool hole formed on a top side of said shoulder and a threaded endpiece axially extended from one end of said shank remote from said shoulder and inserted through the through hole of said handle and fastened with a nut to secure said handle to said axle pin.

7. The eye-protection cover quick-release structure as claimed in claim 6, further comprising two cover boards respectively pivotally connected to left and right sides of said bracket, one said cover board comprising a through hole corresponding to the tool hole of said axle pin.

* * * * *